United States Patent [19]

Westrich

[11] Patent Number: 5,035,012

[45] Date of Patent: Jul. 30, 1991

[54] PORTABLE HAMMOCK KIT AND IMPROVED PORTABLE HAMMOCK

[75] Inventor: James L. Westrich, Algoma, Wis.

[73] Assignee: Gleason Corporation, Milwaukee, Wis.

[21] Appl. No.: 388,633

[22] Filed: Aug. 2, 1989

[51] Int. Cl.[5] ..... A47C 17/04

[52] U.S. Cl. ..... 5/139; 5/121; 5/127; 403/377

[58] Field of Search ..... 5/120, 121, 127, 129, 5/130, 200.6, 201; 403/109, 377; 135/DIG. 9, 108

[56] References Cited

U.S. PATENT DOCUMENTS

| | | | |
|---|---|---|---|
| 488,272 | 12/1892 | Else . | |
| 1,100,608 | 6/1914 | Palmer | 5/121 |
| 1,680,065 | 8/1928 | Proctor | 5/130 |
| 1,719,440 | 7/1929 | Nathan . | |
| 1,846,305 | 2/1932 | Brooks | 5/200 C |
| 2,251,299 | 8/1941 | Spangler | 5/130 |
| 2,618,788 | 11/1952 | [illegible]le | 5/130 |
| 2,646,577 | 7/1953 | Thayer | 5/201 |
| 3,315,281 | 4/1967 | Morris | 5/120 |
| 3,321,780 | 5/1967 | Morris | 5/122 |
| 3,526,909 | 9/1970 | Kotler | 5/123 |
| 3,675,256 | 7/1972 | Tallarico | 5/120 |
| 3,783,458 | 1/1974 | Westrich | 5/129 |
| 4,285,355 | 8/1981 | Lundblade | 135/106 |
| 4,537,392 | 8/1985 | Defibaugh | 135/DIG. 9 |
| 4,757,563 | 7/1988 | An | 5/121 |

FOREIGN PATENT DOCUMENTS

| | | | |
|---|---|---|---|
| 299918 | 6/1989 | European Pat. Off. | 5/120 |
| 2742655 | 4/1979 | Fed. Rep. of Germany | 5/121 |

*Primary Examiner*—Gary L. Smith
*Assistant Examiner*—F. Saether
*Attorney, Agent, or Firm*—Edward J. DaRin

[57] ABSTRACT

A portable hammock kit having aminimum of modular components for assembling and disassembling the modular components for storage or transportation to another location and store all components in a convenient carrying bag. The hammock stand can be assembled with three modular components without fasteners or tools. The hammock stand accommodates a hammock bed suspended from a pair of modular leg assemblies that allow for vertical adjustment of the elevation of both the head and foot ends of the hammock bed. A canopy can be readily mounted and dismounted over the assembled hammock stand.

16 Claims, 4 Drawing Sheets

FIG. 11.
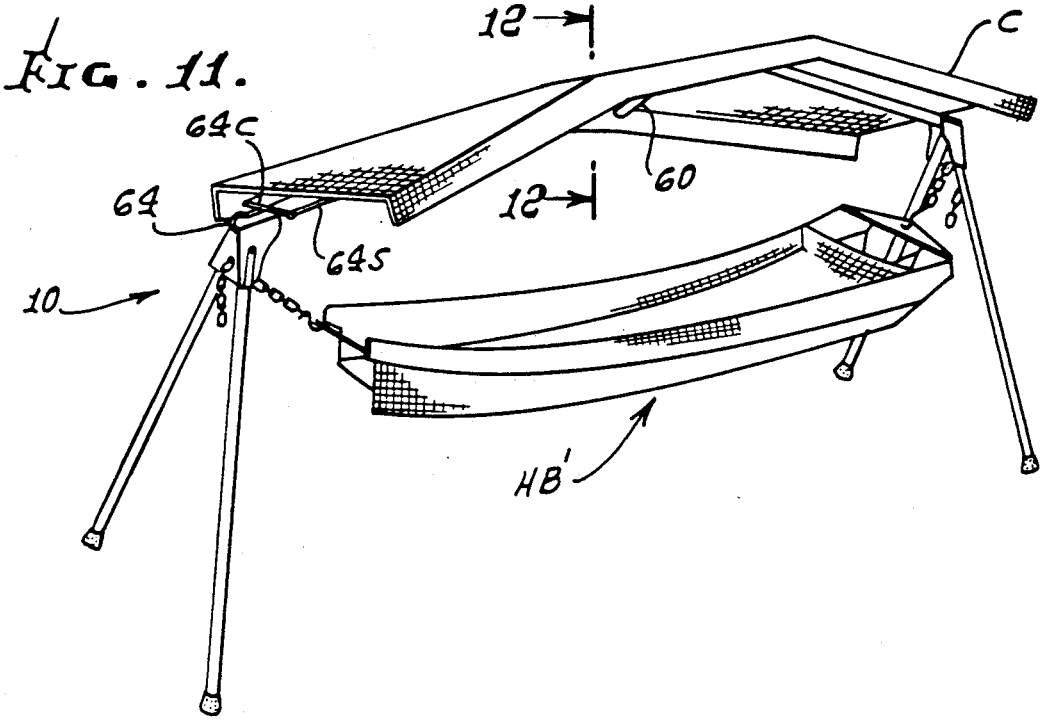
FIG. 12.
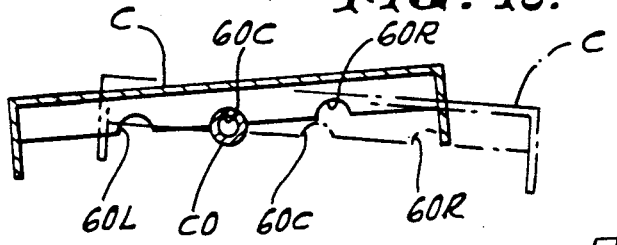
FIG. 14b.
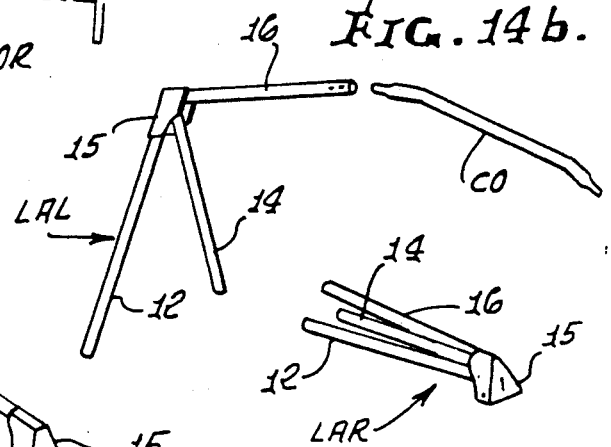
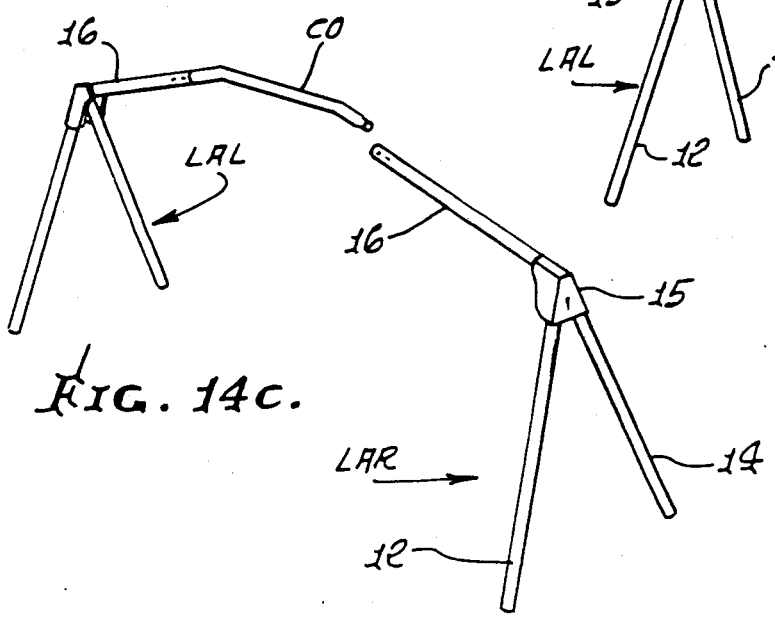
FIG. 14c.

PORTABLE HAMMOCK KIT AND IMPROVED PORTABLE HAMMOCK

FIELD OF INVENTION

This invention generally relates to hammocks and more particularly to improvements in portable hammocks and kits having component hammock parts for readily assembling and disassembling the component parts thereof.

BACKGROUND OF INVENTION

Hammock constructions are well known in the art. Generally, the stands for the prior art hammocks have been totally supported by a stand configuration that is mountable on a supporting surface for completely supporting the hammock bed or an individual seated or reclining in the hammock bed from the supporting surface. This type of hammock is disclosed, for example, in U.S. Pat. Nos. 3,315,281; 3,321,780 and 3,783,458. The latter patent discloses a hammock stand or frame of this type that is collapsible for shipping, storage, or the like. Portable hammocks that are not completely supported from the ground have been disclosed to the workers in the hammock art at early dates and two prior art patents that disclose portable hammocks are found in U.S. Pat. Nos. 488,272, granted on Dec. 20, 1892 and 1,719,440, granted on July 2, 1929. The hammock frame disclosed in patent 488,272 discloses a portable hammock frame structure that is foldable for transport purposes. The hammock frame is constructured with three tripod legs at either end and a single cross member extending between the tripod ends for the hammock frame. The cross member is generally arranged in a horizontal relationship with the tripod ends and is hinged adjacent its center thereof for folding purposes. The hammock bed itself is strung between the tripod ends of the hammock frame from hooks. The U.S. Pat. No. 1,719,440 discloses a hammock or crib support frame wherein two pairs of supporting legs are secured to an individual fitting arranged at opposite ends of the frame with a single, horizontal cross member extending between the legs of the frame. In this early patented device, the supporting legs for the hammock frame are released from their fittings in their hammock supporting position to allow them to be collapsed and extend substantially parallel to the cross bar member to form a collapsed unit, as is particularly evident from examining FIG. 4 of said patent. A more recent portable hammock assembly is disclosed in U.S. Pat. No. 2,251,299 which discloses features generally similar to that of the aforementioned prior art patents. In U.S. Pat. No. 2,251,299, a pair of supporting legs are secured in a preselected spaced apart position at each end of the frame by means of a pair of annularly inclined socket members secured to individual supporting plates. The plates include a third tubular socket for receiving a third arcuate tubular member. The two supporting assemblies are then interconnected by means of a single, straight cross bar that completes the assembly of the hammock frame. This patent also provides for a canopy to overlie the hammock bed over a portion of the stand. The hammock is disassembled by the provision of the tubular telescoping relationship of the supporting legs with the socket members so as to permit it to be foldable with the cross member being releasable from its fastened relationship for ready transportation in a bag or the like. The patent also discloses means for adjusting the elevation relative to the supporting surface of a single end of the hammock bed proper. Other prior art patents disclose various features of improvements to the hammock beds for mounting with the hammock stand and U.S. Pat. No. 3,526,909, for example, discloses a spreader bar for the ends of a hammock for ease of mounting of the hammock bed and also is provided with a hinge for the spreader bar that allows the bed to be folded over upon itself when not installed on a hammock frame for ease of storage or shipment. Despite the disclosure in the prior art, there is still a present need for a simple, inexpensive, portable hammock construction having a minimum number of component parts that is not completely supported by a supporting surface or the ground and that includes a minimum of elements that may be assembled without fasteners, the need for tools or special skills and which may be similarly readily disassembled and forms a compact package that may be inserted into a bag for transportation or shipping purposes.

SUMMARY OF INVENTION

The present invention provides an improved, economical, portable hammock frame that may be manufactured and sold in the form of a kit having a minimum of component parts without fasteners, tools or special skills. In accordance with the present invention, only three basic component parts are required to form the improved portable hammock stand and comprises a pair of tripod-like hammock supporting leg assemblies each having two hammock supporting legs and an overhead member all secured to a shroud member whereby a single crossover member may be utilized for completing the assembly of the portable hammock frame. The crossover member may be readily interconnected with the pair of overhead members for the frame assemblies for permitting the hammock frame to be assembled. In addition to the simple configuration of the hammock stand, the hammock bed itself is arranged to be mounted to the frame to be suspended from the hammock supporting leg assemblies so that both ends of the hammock bed may be independently adjusted in elevation with regard to a supporting surface and thereby allow the user to either elevate his head with respect to his feet, or vice versa, or to permit essentially horizontal positioning of the hammock bed in accordance with the desires of the user. The improved portable hammock may also include a canopy that is readily mounted to the overhead structure of the hammock stand to extend essentially the entire length of the hammock stand for shielding the user from the sun or wind and which is adjustable to be tilted to opposite sides of the symmetrical orientation of the canopy with respect to the hammock stand. The tripod-like hammock supporting leg assemblies include the supporting legs constructed and defined to be pivotably secured to the shroud that allows the legs to be folded into a side-by-side relationship for transport purposes and extends essentially adjacent a third overhead leg secured to the shroud of the hammock supporting leg assemblies for convenience in shipping and storage and which legs are readily pivotable to an upright hammock-supporting position. The crossover member is constructed and defined with arcuate end portions for readily interfitting, in a non-rotatable relationship, with the third overhead legs of the hammock-supporting leg assemblies, whereby a rigid stand is provided for mounting a hammock bed thereon and supporting the users of the hammock bed in a safe manner. The hammock bed itself may be suspended from a single coupling element at the ends of the bed to be adjustably secured at each end with the erect hammock supporting leg assemblies so as to allow the hammock bed to swing with a minimum loss of energy when a slight force is imparted to the bed itself.

From a structural organization standpoint, the present invention provides an improved, portable hammock frame and portable hammock organization that is constructed and defined of modular elements so that the elements may be readily shipped in kit form and may be readily assembled and disassembled. Themodular elements or component parts for the kit, which are only three in number, are constructed and defined as complementary interfitting elements that may be secured together without fasteners for supporting the weight in the hammock bed and yet providing a rigid hammock stand. The hammock bed is also defined to provide a single coupling point for suspension of the hammock bed from the supporting leg assemblies. For this purpose, means for adjustably securing each end of the hammock bed is provided which may be in the form of a chain for securing one end of the chain to the hammock supporting leg assemblies and adapted to be secured to the single coupling element of the hammock bed means. The chain and the coacting hammock supporting leg assemblies are cooperatively constructed and defined to permit independent adjustment of the elevation of the head and foot ends of the hammock bed to desired elevations that may be the same or different, in accordance with the desires of the hammock user. The construction of the shroud for the supporting leg assemblies is particularly improved over prior art structures by locking the chain links in a position to prevent the chain from becoming disengaged in its locking assembly, as is possible with prior art hammock constructions. In addition, canopy means is provided that may also be a portion of the kit which is readily mountable over the top structure of the completed assembly for shielding the user from the sun or the wind. The canopy is constructed and defined to be readily mounted to the overhead structure of the hammock stand and may be mounted in a symmetrical relationship with the hammock bed on opposed sides of the symmetrical position in accordance with the shading or protection required from the sun and the wind.

BRIEF DESCRIPTION OF THE DRAWING

These and other features of the present invention may be fully appreciated when considered in light of the following specification and drawings, in which:

FIG. 11 is a perspective view of the assembled hammock with the canopy mounted thereon;

FIG. 12 is a sectional view taken along the line 12—12 of FIG. 11 illustrating the alternate positions of the canopy in dotted outline;

FIG. 14*b* is a perspective view of the hammock supporting leg assembly of FIG. 14*a* arranged in exploded relationship with the crossover member to be assembled thereto; and FIG. 14*c* is an exploded view of the interconnected elements of FIG. 14*b* arranged to be interconnected to the unassembled hammock supporting leg assembly.

DETAILED DESCRIPTION OF THE PREFERRED EMBODIMENTS

Figure 1:
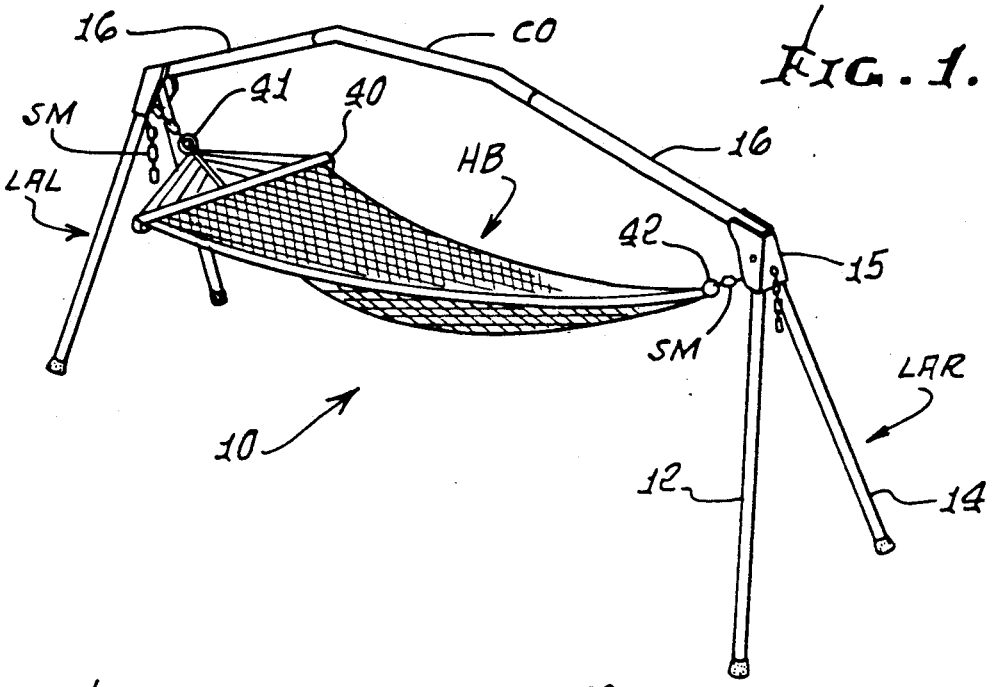
FIG. 1 is perspective view of the assembled hammock embodying the present invention.
Figure 2:
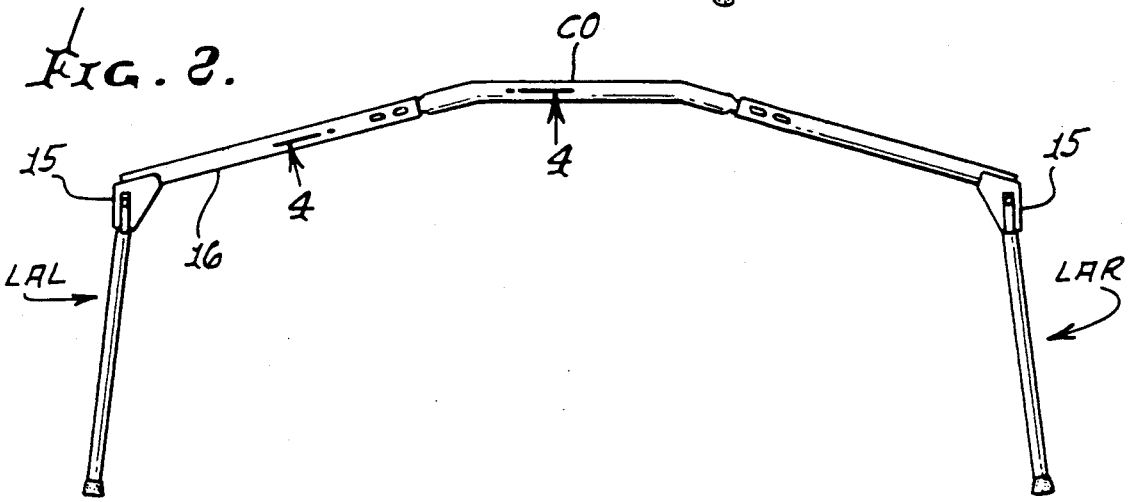
FIG. 2 is an end elevational view of the hammock stand of FIG. 1, without the hammock bed secured to the stand.
Figure 3:
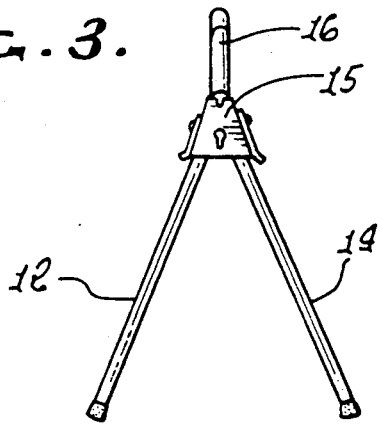
FIG. 3 is an end elevational view of the tripod-like hammock supporting leg assembly.
Figure 13:
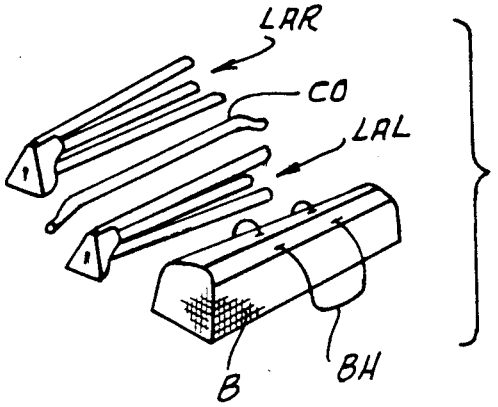
FIG. 13 is an exploded view of the modular component parts of the hammock stand illustrated in relationship to the carrying bag for the component parts of the hammock.

Now referring to the drawings, the construction of the improved hammock 10 including the modular component parts thereof for ready assembly and disassembly will be described in detail. The complete hammock 10 (see FIG. 1) comprises only three modular components for defining a hammock stand assembly, as illustrated in FIG. 2 of the drawings. The modular components comprise two tripod-like hammock supporting leg assemblies LAR and LAL for storage in a fabric bag B, as illustrated in FIG. 13. The bag B may have handles BH for readily carrying the disassembled component parts of the hammock 10 therein. The bag B may also be provided with a shoulder strap (not shown) between the opposite ends of the bag B for permitting the bag to be carried on an individual's shoulder by the shoulder strap. The bag B also stores the hammock bed HB and the hammock bed securing means SM, illustrated in the drawings in the form of two securing chains with a plurality of connected chain links. The securing means SM secure the hammock bed HB to the assembled hammock stand, as illustrated in FIG. 1, for example. The bag B will also store a canopy C mountable over the assembled hammock stand, as illustrated in FIG. 11.

Figure 6:
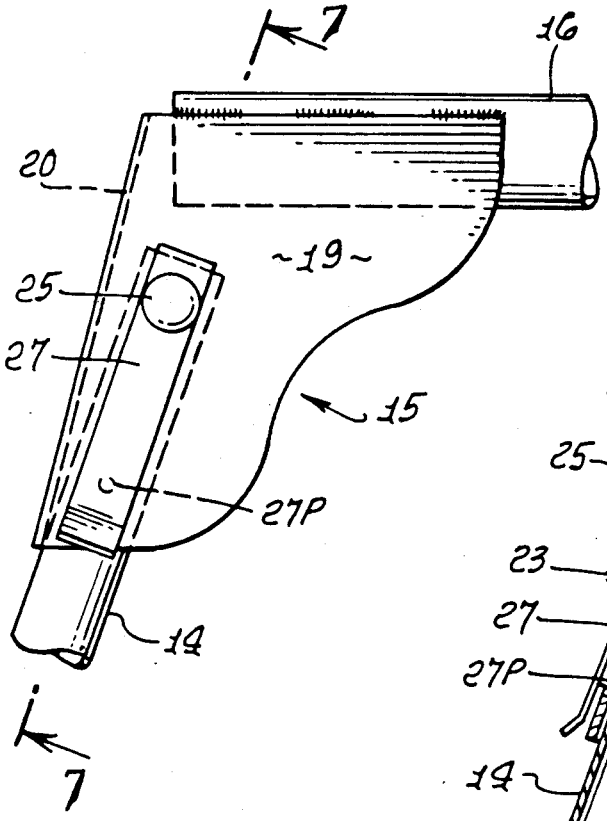
FIG. 6 is a partial elevational view of the shroud assembly of the tripod-like supporting leg assemblies with the legs arranged, in a hammock supporting position.
Figure 7:
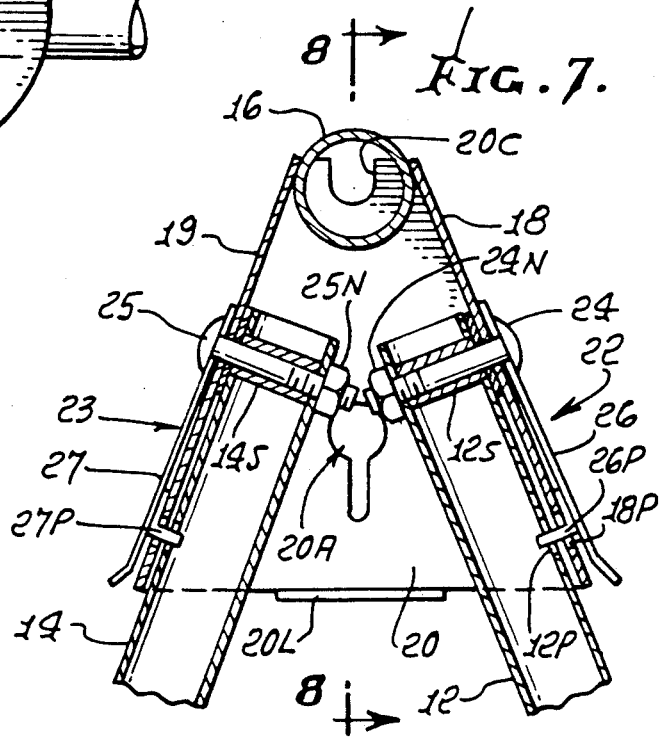
FIG. 7 is a cross-sectional view taken along the line 7—7 of FIG. 6.
Figure 8:
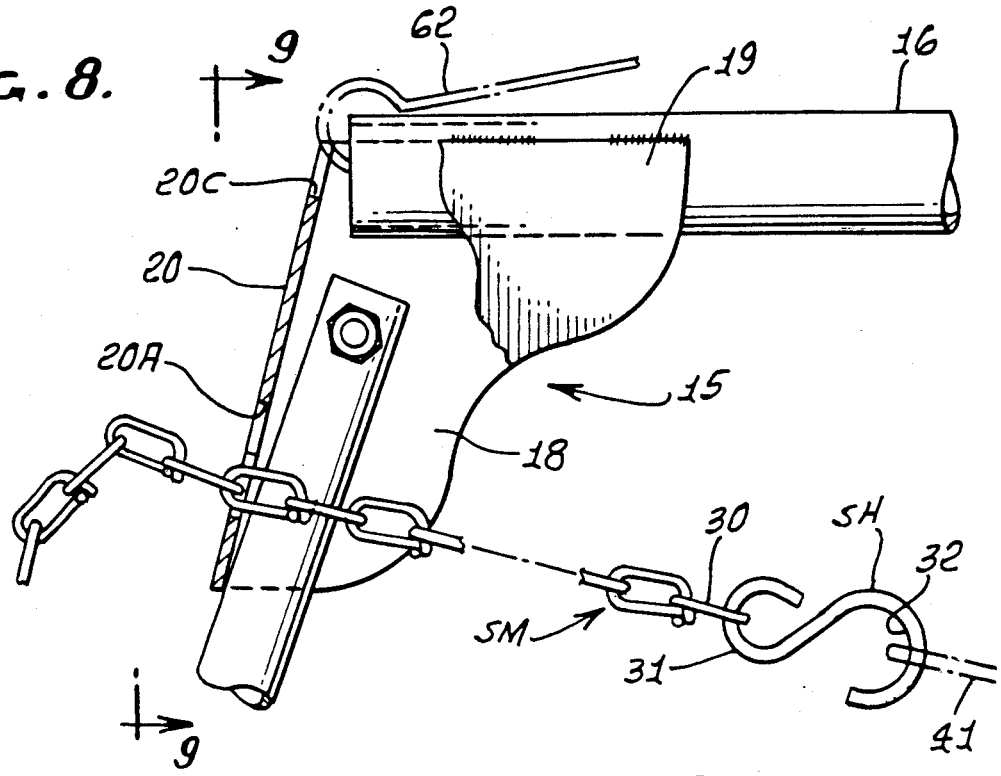
FIG. 8 is a cross-sectional view taken along the line 8—8 of FIG. 7 illustrating the hammock securing chain in position and illustrating the coupling to the hammock bed and the canopy in dotted outline.

The two hammock stands LAR and LAL are constructed identically and, therefore, only one of the tripod-like hammock supporting leg assemblies needs to be explained, as the other supporting leg assembly is identical. The tripod-like hammock supporting leg assembly LA comprises two hammock supporting legs 12 and 14 pivotally secured to a shroud 15 along with a third leg 16 fixed to the shroud 15 in a preselected, fixed relationship therewith and the legs 12 and 14. The shroud 15 has a generally U-shaped configuration and comprises two side plates 18 and 19 of a preselected configuration, as best illustrated in FIGS. 6 and 8, integrally constructed with a rear plate 20 for securing the three legs of the tripod-like hammock supporting leg assemblies to the individual shroud 15. The top ends of side plates 18 and 19 are spaced apart a distance to accommodate the periphery of the third leg 16 that is welded to the plates 18 and 19, so as to extend outwardly thereof, as best illustrated in FIGS. 6 and 8. The side plates 18 and 19 each pivotally support an individual hammock supporting leg 12 and 14, respectively, and may be secured by means of individual spring clips 22 and 23 mounted to the outside surface of the respective plates 18 and 19, as evidenced from examining FIG. 7. Each of the legs 12, 14 and 16 are preferably of a tubular construction. The legs 12 and 14 are secured to the inside surfaces of the plates 18 and 19 of the shroud 15 by means of individual fasteners 24 and 25 which in turn secure spring clips 26 and 27, for respectively securing the legs 12 and 14 in a hammock supporting position when pivoted to such a position. The fasteners 24 and 25 are secured to the outside surfaces of their respective side plates 18 and 19 identically and, therefore, only one need be described, namely, the fastener 24. The fastener 24 secures the spring clip 26 by means of the fastener head through a suitable aperture provided for the clip 22 and a corresponding coaxial aperture for the side plate 18, along with aligned coaxial apertures for the leg 12, all receiving the shank of the fastener 24. A spacer 12S is provided for the leg 12 having a length approximately the same as the inside diameter of the leg 12 whereby the shank of the fastener 24 extends through the opposite walls of the tubular leg 12 and is secured on its outer end by means of a fastener nut 24N. In this fashion, the spring clip 26 is maintained in position overlying the outer surface of the side plate 18 for the shroud 15. The spring clip 26 carries a securing pin 26P which is mounted adjacent the free end thereof for securing the hammock supporting position of the leg 12 when pivoted to that position from its storage or transport folded position for this purpose the side plate 18 is provided with an aperture 18P and the leg 12 is provided with a coaxial aligned aperture 12P for permitting the securing pin 26P to be mounted through the apertures 18P and 12P when the leg is pivoted against the pin 12P for maintaining it in a secured hammock-supporting position. As indicated, the spring clip 27 carries a corresponding locking pin 27P mounted with suitable apertures for the side plate 19 and the leg 14 with corresponding reference numerals, as illustrated in FIG. 7. Similarly, the fastener 25 for the leg 14 is secured by a nut 25N at the inner end of the leg 14. With the above construction of the legs 12 and 14 in mind, the legs may be pivoted inwardly, towards one another, for storage purposes which causes the pins 26P and 27P to be withdrawn from their respective securing apertures, such as the aperture 12P in the leg 12, and frees them for further pivotal movement whereby they are positioned in a side-by-side relationship, as illustrated. When the legs are so pivoted for storage and transportation, they assume a side-by-side relationship and are arranged alongside the fixed leg 16 to provide a compact modular component of the hammock, as illustrated in FIG. 13, for example.

The shroud 15 includes means for securing the securing member or chain SM therein for adjusting the elevation of the hammock bed HB above the supporting surface. For this purpose a keyhole aperture 20A (see FIGS. 7 and 9) is provided at the rear plate 20 of the shroud 15 for receiving and securing the securing member SM. For this purpose the keyhole aperture 20A has an enlarged portion illustrated in the drawings as the top portion for receiving a securing member or the chain SM proper therein and is then slidable into the locking aperture 20AL arranged below the receiving aperture 20AR for securing one of the links of the chain therein in accordance with the desired elevation of the head or foot of the hammock bed HB, as will be described immediately hereinafter. The shroud 15 also includes an inwardly extending lip 20L constructed integrally with the shroud 15 and arranged at the bottom end of the back plate 20 and extends a preselected distance inwardly of the plate 20 to support the lower edge of the shroud 15. This section 20L prevents distortion of the lower shroud edge when weight is applied to the securing element SM secured in the aperture 20AL. The opposite or top end of the back plate 20 is also provided with a securing aperture 20C of an essentially semicircular configuration at the end and is spaced from the secured end of the third leg 16 for securing the canopy C to the tripod-like hammock supporting leg assembly LAL.

Figure 4:
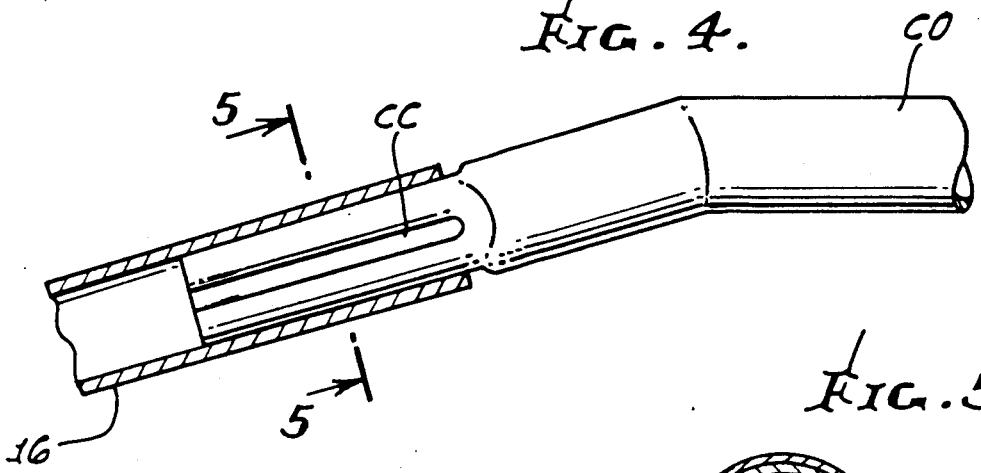
FIG. 4 is a partial elevational and cross-sectional view of the interconnected parts of the hammock taken along the line 4—4 of FIG. 2.
Figure 5:
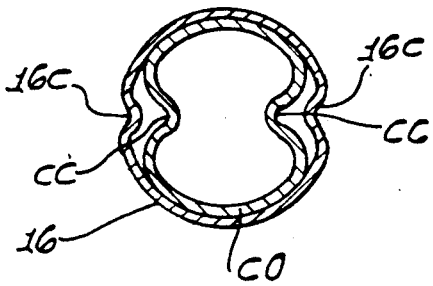
FIG. 5 is a cross sectional view of the interconnected parts taken along the line 5—5 of FIG. 4.
Figure 9:
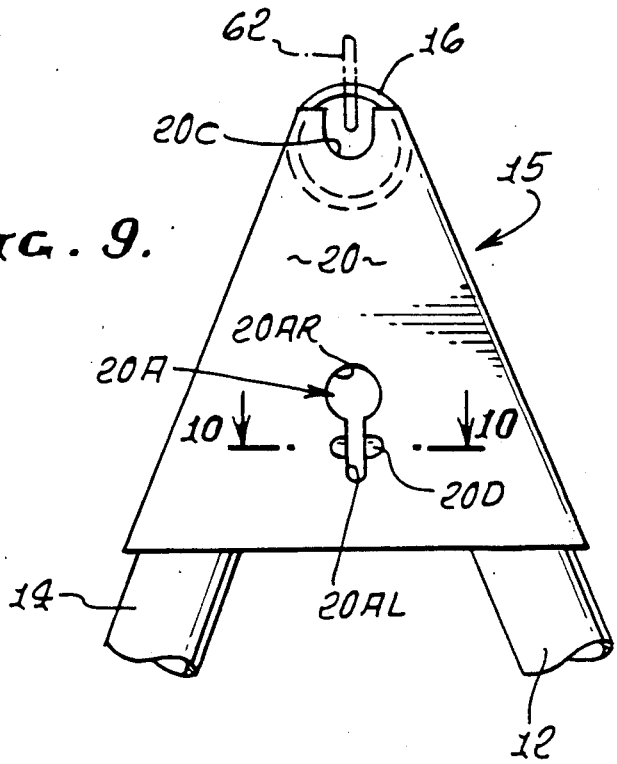
FIG. 9 is a front elevational view taken along the line 9—9 of FIG. 8 without the securing chains.
Figure 10:
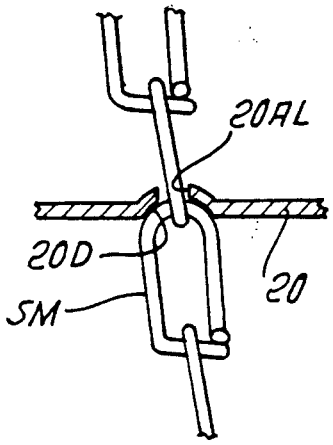
FIG. 10 is a cross-sectional view of the securing arrangement for the hammock supporting chain taken along the line 10—10, of FIG. 9.

Now referring to FIGS. 8–10, the specific structural organization for adjustably securing the securing member SM to support the hammock bed HB in a desired elevational position will be further examined relative to the design of the shroud 15. The securing member SM is illustrated in its presently preferred form, namely, a chain having a plurality of connected links to extend between an end of the hammock bed HB and through the keyhole aperture 20A for the shroud 15. The aperture 20A has a diameter of a size to permit the links of the securing chain SM to freely pass therethrough and then moved outwardly to the securing portion of the aperture, namely, the aperture 20AL for securing the chain to provide a desired elevation for the adjacent end of the hammock bed HB. To correctly maintain the position of the chain SM and prevent it from sliding through the aperture 20AL as may occur in some prior art structures, the aperture 20AL is provided with a securing detent 20D, as best illustrated in FIGS. 9 and 10, so that a selected chain link is secured against the detent 20D, as best illustrated in FIG. 10, to prevent the weight in the hammock bed HB or the hammock bed itself, from causing the chain SM to slip through the securing aperture 20AL. The free end of the chain securing member SM will extend outwardly of the aperture 20AL in a loose configuration, the length being selected in accordance with the desired elevations for the adjacent end of the hammock bed HB. The opposite end of the securing chain SM is provided with an "S" shaped hook SH with a pair of openings so that it may be coupled between an end of the hammock bed HB and the free link on the securing member SM. The free end of the securing chain SM is identified by the reference numeral 30 and is engaged with the smaller opening for the "S" hook SH identified by the reference numeral 31 in FIG. 8. The larger opening 32 at the opposite end of the "S" hook SH is arranged to receive a single coupling member for the hammock bed HB, as will be explained immediately hereinafter. It is understood that the present invention permits both ends of the hammock bed HB to be adjusted in elevation, independently. The remaining module element for defining the hammock stand per se is the crossover member CO. The crossover member, as best appreciated from examining FIG. 2, has a straight section intermediate its ends and each end section constructed and defined with an arcuate configuration for interfitting in a telescopic relationship with the adjoining third legs 16 for each of the pair of tripod-like hammock supporting leg assemblies LAR and LAL. The described interfitting relationships are illustrated in FIGS. 1 and 2, for example. The arcuate end sections for the element CO are defined relative to the third legs 16 since these legs extend outwardly and upwardly from their respective shroud members 15 so that the two legs may be readily inerfitted, and when interfitted, support the hammock stand in an upright position and any weight resting in the hammock bed HB proper. In the preferred arrangement, the opposite end sections of the crossover member CO are swaged at the arcuate end sections for providing a complementary, interfitting relationship with the free ends of the third legs 16 for each tripod-like hammock supporting leg assemblies LAL and LAR. The interfitted relationship is best illustrated in FIGS. 4 and 5. The swaged end sections of the crossover member CO have essentially a figure "8" configuration seen from its free end, as is best illustrated in FIG. 5. For this purpose the ends of the "8" have longitudinally extending concavities CC at opposite sides thereof extending the full length of the arcuate sections for the crossover member CO. The outside dimensions of the swaged arcuate end sections of element CC are dimensioned so as to tightly interfit with the inside wall of the associated third leg 16; see FIG. 5. For this purpose, the free end of the third legs 16 are each defined with inwardly extending securing elements 16C for receiving the ends of the crossover member CO and receiving it in only one orientation and to prevent relative rotation of the secured element 16 and the end of the element CO. This relationship is best illustrated in FIGS. 4 and 5. The opposite end of the crossover member CO is similarly defined relative to the remaining third leg 16 for the other tripod-like hammock supporting leg assemblies, as illustrated. This swaged configuration for the member CO not only better supports the hammock stand and any weight in the mounted hammock but also allows the parts to be interfitted without the need to resort to fasteners or special tools and essentially prevents the improper insertion of the interfitted elements at both ends thereof in accordance with the desired modular configuration of the present invention for providing a kit of modular components.

Figure 14A:
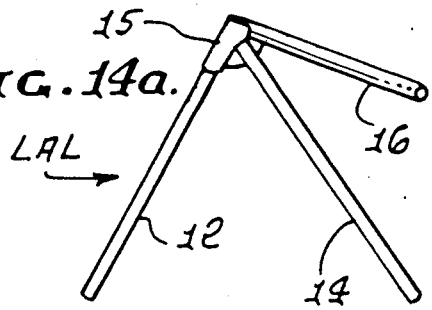
FIG. 14*a* is a perspective view of a tripod-like hammock supporting leg assembly illustrating the supporting legs in a hammock supporting position.

With the above structure in mind, the arrangement of the modular elements comprising the hammock 10 for assembly and disassembly will now be described in detail. It will be initially assumed that each of the tripod-like hammock supporting leg assemblies LAR and LAL have their hammock supporting legs, such as the legs 12 and 14 of assembly LAL, pivoted or folded to a storage position, as illustrated in FIG. 13. In this folded condition, the assemblies LAR and LAL, the crossover member CO and the securing chain SM are removed from the bag B along with the hammock bed HB for the present purposes. To assemble the hammock stand in the configuration illustrated in FIG. 2, one of the hammock supporting leg assemblies, such as the assembly LAL, as illustrated in FIG. 14*a*, is grasped so as to pivot the supporting legs 12 and 14 away from its storage position to cause the ground engaging ends of the legs 12 and 14 to be pivoted in a spaced apart relationship, as illustrated. The legs are pivoted apart until the locking pins 26P and 27P for the spring clips 26 and 27 respectively, lock the legs in an upright position, as illustrated in FIG. 14*b*. At this stage of assembly, the leg assembly LAL is oriented with regard to the supporting surface to receive the crossover member CO at the leg 16, as illustrated in exploded relationship in FIG. 14*b*. The remaining leg assembly LAR at this time is still maintained on the ground in its folded position. The next assembly step is the interfitting of the crossover member CO and the free end of the leg 16 to assume the configuration illustrated in FIG. 14C. The hammock frame is completed by pivoting the legs 12 and 14 for the supporting leg assembly LAR in a spaced apart relationship, as described hereabove, for the leg assembly LAL; see FIG. 14*c*. In this arrangement, the remaining end of the crossover member CO is interfitted to the free end of the third leg 16 for the leg assembly LAR and when so interfitted, the stand will assume the completed assembly configuration of FIG. 2. This provides an improved hammock stand that can be assembled by only the three modular components and is easily disassembled utilizing the steps described in reverse. In the reverse relationship, the crossover member CO is freed from each third leg 16 and then the pivotable legs of the leg assemblies LAR and LAL are pivoted out of their secured relationship and the free ends moved towards one another wherein they lie essentially side-by-side adjacent the third leg 16 for reinsertion into the bag or carrier B.

To complete the hammock 10, the thus assembled hammock stand will have the hammock bed HB secured thereto. The hammock bed HB is illustrated in FIG. 1 in the form of a conventional rope-style hammock bed having a head end illustrated at the left hand end of FIG. 1 and a foot end at the right hand end of the hammock bed HB. The head end has a stabilizing bar 40 to receive the rope ends that are threaded through suitable apertures provided in the bar 40. These rope ends are individually tied together to a single coupling element illustrated as the coupling loop 41, so as to be secured to the "S" hook SH at the free end of the securing member SM. The open end of the "S" hook SH or the end 32 is secured to the loop 41 or the single coupling element 41 to suspend the head end of the hammock bed HB. The foot end of the hammock bed HB is not provided with a stabilizer bar, but has the ends of the ropes defining the bed secured together at one end and to a corresponding single coupling loop 42 for securing the "S" hook SH for the foot end tripod-like hammock supporting leg assembly LAR. In the assembly of the hammock bed HB to the hammock stand, it is preferred to first insert the securing chain SM into the securing aperture SA with the "S" hook arranged on the inside of the shroud 15, as illustrated in FIG. 8. The opposite end of the chain SM would then be secured into the detent 20D for the securing aperture 20AL to secure the chain in the desired elevation, as illustrated in detail in FIG. 10. The hammock bed HB then can be secured to the free end of the "S" hook SH for coupling one end thereof and once the securing member for the opposite leg assembly is mounted to the respective leg assembly, the hook SH can be coupled to the coupling element 42 for the foot end of the hammock bed HB. In this fashion, the head end may be elevated readily by manipulation of the chain securing detent 20D to either pull more chain through the securing aperture 20A or to release a portion of the chain in accordance with whether the elevation of the head of the hammock bed HB is to be elevated or lowered, respectively. Similarly, the foot end of the hammock bed HB may be adjusted in elevation in accordance with the desires of the user.

It should be recognized that this ability to adjust both ends of the hammock bed HB may be desired for therapeutic purposes required by the hammock user with regard to the blood of the body either rising to the head or the legs. It should now be recognized that the disassembly of the hammock 10 follows the same sequence, but in reverse. The hammock bed HB may first be detached from the securing "S" hooks for storage back into the bag B, For this purpose, the hammock bed HB may be rolled up and inserted into the bag B. The leg assemblies AR and LAL are removed from the CO and then folded.

In accordance with the present invention, the canopy C is provided for the hammock 10 to cover essentially the entire length of the hammock bed HB and one such arrangement is illustrated in FIG. 11. FIG. 11 illustrates a hammock 10 embodying the present invention but having a hammock bed HB' that is constructed of a fabric material rather than a rope, as is conventional in the art. The hammock bed HB' is illustrated suspended from a single coupling element at each end, as described hereinabove. The canopy C is constructed of a length of fabric which may be a plastic fabric which has a plurality of reinforcing wooden rods spaced apart along the length thereof. For this purpose only one such rod is illustrated in FIG. 11 and is identified as the rod 60. A second rod spaced towards the head end of the hammock bed HB' may also be provided, along with reinforcing bars provided at the opposite ends of the canopy C and sewn into a hem of the fabric at the opposite ends. The rods 60 have a lengths so as to terminate in a spaced relationship with the longitudinal edges of the canopy fabric. Fabric pockets may be provided to secure the rods 60 to the fabric of the canopy C. The longitudinal edges of the canopy C outside of the rods 60 may be turned downwardly, as illustrated in FIG. 11. Each of the reinforcing rods, intermediate the ends of the canopy C, may have three canopy adjusting notches defined thereon for orienting the canopy C with respect to the hammock bed HB' relative to the direction of the sun or wind that is desired to mask or screen out. Each rod 60, then, has a supporting notch having a semicircular configuration arranged centrally of the bar and identified as the notch 60C with a pair of notches 60L and 60R arranged on opposite sides of the notch 60C for moving the canopy to either one side of the notch 60C or the other in accordance with the direction of the sun, for example. When the reinforcing bars 60 are mounted over the overhead tubular elements of the hammock stand and the notch 50C is engaged by the crossover member CO, for example, the adjusting notches will be seated therein; see FIG. 12, wherein the canopy will be symmetrically oriented with regard to the overhead stand structure and overlie the hammock bed HB' symmetrically. By tilting the canopy C so as to engage the notches 60L and 60R, the canopy may be oriented either to the left or the right of the symmetrical relationship of the canopy C and the hammock bed HB, as illustrated in dotted outline in FIG. 12 for providing the desired shading for the user of the hammock 10.

One end of the canopy C may be provided with a hook for directly securing the hook through the aperture 20C for the shroud 15 to the inner wall of a leg 16, as described hereinabove. As illustrated in FIG. 11, the canopy C, at the head end of the hammock 10 (right hand side as illustrated) has a hook-like member 62 secured to the end reinforcing rod at the head end of the canopy C for engaging the aperture 20C in the manner best illustrated in FIG. 8, for example. The canopy hook 62 for this purpose is illustrated in FIG. 8 as the hook 62 which merely engages the inside wall of the third leg 16 means of the access permitted by the aperture 20C. In the preferred securing arrangement for the canopy C, the opposite end of the canopy C may be provided with a similar hook that is secured to the end reinforcing rod by means of adjustable straps secured to a T-bar hook 64, as is illustrated in FIG. 11. For this purpose, the T-bar hook 64 comprises a single hook-like element for securement to the leg assemblies as described hereinabove, with a cross member 64C at its opposite end secured to a plurality of adjustable straps 64S, in turn secured to the adjacent canopy reinforcing rod to permit the canopy to be longitudinally adjusted so as to be tightly mounted between the leg assemblies without any slack and to avoid being tipped off its hammock stand by winds or the like. The details of the adjusting straps are not illustrated as they are of a conventional construction.

It should now be evident that the present invention provides an improved, portable hammock stand comprising three modular elements that permits the stand to be readily assembled and disassembled. The hammock stand mounts a hammock bed that can have its opposite ends adjusted in elevation and positively secured in position. A hammock canopy is also provided. All elements of hammock fit into the carrying bag, namely, the three modular elements, chains, hammock bed and canopy, for storage and portability.

I claim:

1. In a portable hammock having three modular components defining a hammock stand assembly comprising a pair of tripod-like hammock supporting leg assemblies wherein each leg assembly comprises a shroud, a pair of hammock supporting legs pivotally secured to the shroud adjacent an end of each leg so that the legs lie side-by-side when pivoted to a nonsupporting position for transport purposes and to be pivoted outwardly of the shroud to cause the free ends of the legs to be spaced apart in a releasable, secured hammock supporting position when the free ends of the legs engage a supporting surface, and a third leg for each leg assembly secured at one end thereof to an individual shroud in a nonmovable position and to lie adjacent the pair of supporting legs when said legs are in a nonsupporting, folded position whereby the hammock leg assemblies may be readily transported and set up to support a hammock bed; said third leg being secured to extend outwardly and upwardly of said shroud when the other legs of said shroud are in engagement with a supporting surface, a one piece crossover member having a straight section intermediate its ends with each end being angled downward to align in a straight line with each third leg and each end being adapted to be readily interconnected for securement with said third leg of an individual leg assembly for defining a hammock bed supporting stand when the pair of legs for each pair of leg supporting assemblies have been pivoted to a hammock supporting position and the crossover member is rigidly secured at its ends to each one of the third legs for each leg assembly, the free ends of each third leg and each end of the cross-over member being constructed and defined in a complementary fashion so as to be releasably secured to one another in a non-rotatable relationship with one another, without fasteners, and to be readily disassembled from one another, the shroud for each leg assembly is constructed and defined with means for adjustably securing a preselected style of hammock bed thereto to permit both ends of the hammock bed to be individually adjusted in vertical elevation, said shroud means comprising a securing aperture of a pre-selected configuration for loosely receiving a securing member within the aperture and movable within the aperture to a securable position for engaging a securing member in a non-loose securing position, said securing aperture having a keyhole-like configuration and the securing member is a chain having a plurality of links with one end adapted to be secured to a hammock bed, said keyhole-like configuration is constructed and defined with detent means intermediate the ends of the keyhole-like configuration for positively securing a link of a securing chain by means of the detent means for fixing the elevation of the adjacent end of the hammock bed.

2. In a portable hammock as defined in claim 1 including hammock bed means having chain means for adjustably securing the bed at opposite ends thereof to an individual shroud of said leg assemblies.

3. In a portable hammock as defined in claims 1 or 2 including canopy means removably mounted over the thus defined hammock bed supporting stand to overlie the secured crossover member and said third legs, the canopy having means for securing each end thereof to the shroud of an individual leg assembly.

4. A portable hammock as defined in claim 1 wherein each pair of tripod-like hammock supporting leg assemblies include a pair of releasable spring clip means secured to opposite sides of the shroud for releasably securing each of the supporting legs in an unfolded supporting position.

5. A portable hammock as defined in claims 2 or 3 including canopy means for adjustably mounting the same over the hammock bed means for permitting the canopy means to be positioned in a plurality of sunshielding positions, including directly over the bed means.

6. A portable hammock as defined in claim 1 wherein the legs for each pair of supporting leg assemblies and the crossover member are of a tubular construction.

7. A portable hammock as defined in claim 6 wherein the opposite ends of the crossover member and the free ends of said third legs are of complementary swaged configuration for permitting the ends to be aligned and interfitted in only one preselected relationship.

8. A portable hammock as defined in claim 2 wherein the hammock bed means includes stabilizing means arranged adjacent each end of the bed means and the bed means comprises a single coupling element for suspending the hammock bed from the pair of supporting leg assemblies.

9. A portable hammock as defined in claim 2 wherein the hammock bed means includes stabilizing means arranged adjacent each end of the bed means and the bed means comprises a fabric style bed secured between said stabilizing means and a single coupling element for suspending the hammock bed from the pair of supporting leg assemblies.

10. A kit for assembling a portable hammock stand only having three modular component parts capable of being readily assembled without fasteners and tools, all of the component parts comprising said portable hammock include the hammock bed and the three modular components thereof which are stored in a single bag for portability, the kit comprising a pair of tripod-like hammock supporting leg assemblies, each leg assembly including a pair of hammock supporting legs and shroud and a crossover member, the pair of supporting leg assemblies being each pivotally secured adjacent one end thereof to the shroud for pivotal movement between a folded position for storage and transport whereby the pair of legs for each leg assembly extend outwardly of the shroud in a side-by-side relationship and pivotable to an upstanding position so that the free ends of each pair of legs assume a spaced apart relationship for mounting on a supporting surface, the shroud and said ends of the pair of legs being constructed and defined for coaction to permit the legs to be releasably secured in the upstanding position when pivoted to said position, a third straight leg secured adjacent one end thereof to said shroud in a nonmovable relationship and arranged to lie along side the pivotable legs when they are in a folded position for storage and to extend outwardly and upwardly of the shroud when the pivotable legs have been pivoted to said upright position, said crossover member being a single piece having a straight section intermediate its ends with each end being angled downward to align in a straight line with each third leg, the end sections of the crossover member and the free ends of the third legs for each leg assemblies being defined and constructed for complementary interfitting with one another in a preselected releasably securable relationship when an arcuate end section is interfitted with an individual third leg without fasteners, to thereby interconnect the pair of leg assemblies in a non-rotatable relationship to complete the assembly of the hammock stand, said shroud means comprising a securing aperture of a preselected configuration for loosely receiving a securing member within the aperture and movable within the aperture to a securable position for engaging a securing member in a non-loose, securing position, said securing aperture having a keyhole-like configuration and the securing member is a chain having a plurality of links with one end adapted to be secured to a hammock bed, said keyhole-like configuration is constructed and defined with detent means intermediate the ends of the keyhole-like configuration for positively securing a link of a securing chain by means of the detent means for fixing the elevation of the adjacent end of the hammock bed without the securing means slipping out of adjustment and without distorting the shroud with the application of weight transmitted thereto.

11. A kit for assembling a portable hammock as defined in claim 10 including a hammock bed of a preselected style and a pair of means for securing the hammock bed to each of the hammock supporting leg assemblies, the shroud for each of the supporting leg assemblies being similarly constructed and defined relative to said securing means to permit coactive, adjustable assembly of one end for each of the securing means with said shrouds for adjusting the elevation of each end of the hammock bed when each remaining end of the securing means has been secured to an individual end of the hammock bed the shroud being constructed and defined without the securing means slipping out of adjustment and without distorting the shroud with the application of weight transmitted thereto.

12. A kit for assembling a portable hammock as defined in claim 10 wherein each shroud includes a pair of releasable means for securing each individual pair of hammock supporting legs in said upstanding position, said releasable means and the adjacent ends of each leg of each pair of supporting legs being defined and constructed in a complementary fashion for releasable engagement with one another.

13. A kit for assembling a portable hammock as defined in claim 10 including canopy means adapted to be releasably secured to the assembled hammock stand at the opposite ends thereof to an individual tripod-like hammock supporting assembly when the canopy means has been positioned over the top of the assembled hammock stand.

14. A kit for assembling a portable hammock as defined in claim 13 wherein the canopy is adapted to be selectively mounted directly over a hammock bed or positioned over either side of the hammock stand for shading the user of the hammock bed from the sun in accordance with the relative positions of the sun and the assembled hammock stand.

15. A portable hammock as defined in claim 2 wherein the hammock bed means includes stabilizing means arranged adjacent each end of the bed means and the bed means comprises a rope-style bed secured between said stabilizing means and a single coupling element for suspending the hammock bed from the pair of supporting leg assemblies.

16. In a portable hammock comprising a pair of tripod-like hammock supporting leg assemblies wherein each leg assembly comprises a shroud, a pair of hammock supporting legs pivotally secured to the shroud adjacent an end of each leg so that the legs lie side-by-side when pivoted to a nonsupporting position for transport purposes and to be pivoted outwardly of the shroud to cause the free ends of the legs to be spaced apart in a secured hammock supporting position when the free ends of the legs engage a supporting surface, and a third leg secured to the shroud in a nonmovable position and to lie adjacent the pair of supporting legs when said legs are in a nonsupporting, folded position whereby the hammock leg assemblies may be readily transported and set up to support a hammock bed; said third leg being secured to extend outwardly and upwardly of said shroud when a leg assembly is in a hammock supporting position, a crossover member having a straight section intermediate its ends with each end having an arcuate configuration and each end being adapted to be readily interconnected for securement with said third leg of an individual leg assembly for defining a hammock bed supporting stand when the pair of legs for each pair of leg supporting assemblies have been pivoted to a hammock supporting position and the crossover member is rigidly secured in a non-rotatable position at its ends to one of the third legs for each leg assembly without fasteners; the shroud for each leg assembly is constructed and defined with means for adjustably securing a preselected style of hammock bed thereto to permit both ends of the hammock bed to be individually adjusted in vertical elevation, canopy means removably mounted over the thus defined hammock bed supporting stand to overlie the secured crossover member and said third legs, the canopy having means for securing each end thereof to the shroud of an individual leg assembly, the canopy means is constructed and defined with supporting cross members spaced along the length thereof and each member having spaced apart grooves shaped to engage the interconnected third legs and crossover member for engaging the cross members in the grooves to selectively permit the canopy means to be symmetrically mounted directly over the hammock bed means or unsymmetrically on opposite sides of said directly overhead position for shielding from the sun.

* * * * *